US006575255B1

(12) United States Patent
Rial et al.

(10) Patent No.: US 6,575,255 B1
(45) Date of Patent: Jun. 10, 2003

(54) PANTOGRAPH UNDERREAMER

(75) Inventors: Monty H. Rial, Dallas, TX (US); Lawrence W. Diamond, Rockwall, TX (US); Harold E. Payne, Spring, TX (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 09/929,551

(22) Filed: Aug. 13, 2001

(51) Int. Cl.[7] ..... E21B 10/62

(52) U.S. Cl. ..... 175/57; 175/285

(58) Field of Search ..... 175/285, 284, 175/272, 289, 57

(56) References Cited

U.S. PATENT DOCUMENTS

| | | | | | |
|---|---|---|---|---|---|
| 54,144 | A | | 4/1866 | Hamar | 175/263 |
| 274,740 | A | | 3/1883 | Doulgass | |
| 639,036 | A | | 12/1899 | Heald | 175/263 |
| 1,189,560 | A | | 7/1916 | Gondos | 175/265 |
| 1,285,347 | A | | 11/1918 | Otto | 175/263 |
| 1,317,192 | A | * | 9/1919 | Jones | 175/202 |
| 1,467,480 | A | | 9/1923 | Hogue | 175/263 |
| 1,485,615 | A | | 3/1924 | Jones | 175/263 |
| 1,498,463 | A | * | 6/1924 | McCloskey et al. | 175/173 |
| 1,674,392 | A | | 6/1928 | Flansburg | |
| 1,970,063 | A | * | 8/1934 | Steinman | 175/202 |
| 2,018,285 | A | | 10/1935 | Schweitzer et al. | 166/21 |
| 2,031,353 | A | * | 2/1936 | Woodruff | 175/285 |
| 2,069,482 | A | | 2/1937 | Seay | 255/76 |
| 2,150,228 | A | | 3/1939 | Lamb | 166/10 |
| 2,169,502 | A | * | 8/1939 | Santiago | 175/217 |
| 2,169,718 | A | | 8/1939 | Böll et al. | 255/24 |
| 2,450,223 | A | | 9/1948 | Barbour | 255/76 |
| 2,490,350 | A | | 12/1949 | Grable | 166/4 |
| 2,679,903 | A | | 6/1954 | McGowen, Jr. et al. | 166/1 |
| 2,847,189 | A | | 8/1958 | Shook | 255/76 |
| 3,379,266 | A | * | 4/1968 | Fletcher | 175/285 |
| 3,397,750 | A | * | 8/1968 | Wicklund | 175/18 |
| 3,443,648 | A | | 5/1969 | Howard | 175/103 |
| 3,528,516 | A | | 9/1970 | Brown | 175/267 |
| 3,684,041 | A | | 8/1972 | Kammerer, Jr. et al. | 175/267 |
| 3,757,876 | A | | 9/1973 | Pereau | 175/267 |
| 3,757,877 | A | | 9/1973 | Leathers | 175/269 |
| 4,073,351 | A | | 2/1978 | Baum | 175/14 |
| 4,169,510 | A | | 10/1979 | Meigs | 175/65 |

(List continued on next page.)

OTHER PUBLICATIONS

Pend Pat App, Monty H. Rial et al., "*Pantograph Underreamer*," SN 09/929,175 (067083.0142), Filed Aug. 13, 2001.

Pend Pat App, Monty H. Rial et al., "*Pantograph Underreamer*," SN 09/929,568 (067083.0145), Filed Aug. 13, 2001.

Pend Pat App, Lawrence W. Diamond et al., "*Single–BladeUnderreamer*," SN 09/932,482 (067083.0125), Filed Aug. 17, 2001.

Pend Pat App, Lawrence W. Diamond et al., "*Multi–Blade Underreamer*," SN 09/932,487 (067083.0136), Filed Aug. 17, 2001.

Pend Pat App, Monty H. Rial et al., "*Pantograph Underreamer*," SN 10/079,444 (067083.0143), Filed Feb. 19, 2002.

Nackerud Product Description, Rec'd Sep. 27, 2001.

*Primary Examiner*—Hoang Dang
(74) *Attorney, Agent, or Firm*—Baker Botts L.L.P.

(57) ABSTRACT

An underreamer for forming a cavity within a well bore is provided. The underreamer may include a housing rotatably disposed within the well bore. The underreamer may also include a sleeve slidably positioned around the housing. The underreamer may further include at least one cutter set where each cutter set is pivotally coupled to the housing and the sleeve. An axial force applied to the sleeve operates to slide the sleeve relative to the housing and extend each cutter set from a retracted position radially outward relative to the housing to form the cavity when the housing is rotated.

32 Claims, 4 Drawing Sheets

U.S. PATENT DOCUMENTS

| | | | | |
|---|---|---|---|---|
| 4,189,184 | A | | 2/1980 | Green ..... 299/8 |
| 4,278,137 | A | | 7/1981 | Van Eck ..... 175/267 |
| 4,323,129 | A | | 4/1982 | Cordes ..... 175/285 |
| 4,366,988 | A | | 1/1983 | Bodine ..... 299/14 |
| 4,396,076 | A | | 8/1983 | Inoue ..... 175/265 |
| 4,401,171 | A | | 8/1983 | Fuchs ..... 175/267 |
| 4,407,376 | A | | 10/1983 | Inoue ..... 175/267 |
| 4,494,616 | A | | 1/1985 | McKee ..... 175/67 |
| 4,558,744 | A | | 12/1985 | Gibb ..... 166/335 |
| 4,565,252 | A | | 1/1986 | Campbell et al. ..... 175/269 |
| 4,618,009 | A | | 10/1986 | Carter et al. ..... 175/267 |
| 4,674,579 | A | | 6/1987 | Geller et al. ..... 175/45 |
| 4,715,440 | A | | 12/1987 | Boxell et al. ..... 166/100 |
| 4,830,105 | A | | 5/1989 | Petermann ..... 166/241 |
| 5,036,921 | A | | 8/1991 | Pittard et al. ..... 166/298 |
| 5,135,058 | A | | 8/1992 | Millgard et al. ..... 175/71 |
| 5,148,875 | A | | 9/1992 | Karlsson et al. ..... 175/62 |
| 5,201,817 | A | | 4/1993 | Hailey ..... 175/269 |
| 5,242,017 | A | | 9/1993 | Hailey ..... 166/55.8 |
| 5,255,741 | A | | 10/1993 | Alexander ..... 166/278 |
| 5,271,472 | A | | 12/1993 | Leturno ..... 175/107 |
| 5,363,927 | A | | 11/1994 | Frank ..... 175/67 |
| 5,385,205 | A | | 1/1995 | Hailey ..... 166/55.8 |
| 5,402,856 | A | | 4/1995 | Warren et al. ..... 175/57 |
| 5,494,121 | A | | 2/1996 | Nackerud ..... 175/263 |
| 5,499,687 | A | | 3/1996 | Lee ..... 175/317 |
| 5,722,489 | A | | 3/1998 | Lambe et al. ..... 166/269 |
| 5,853,054 | A | | 12/1998 | McGarian et al. ..... 175/267 |
| 6,070,677 | A | * | 6/2000 | Johnston, Jr. ..... 166/174 |
| 6,227,312 | B1 | | 5/2001 | Eppink ..... 175/57 |
| 6,378,626 | B1 | | 4/2002 | Wallace ..... 175/19 |

* cited by examiner

PANTOGRAPH UNDERREAMER

RELATED APPLICATIONS

This application is related to application Ser. No. 09/929,568, entitled "Pantograph Underreamer," filed on Aug. 13, 2001; and application Ser. No. 09/929,175, entitled "Pantograph Underreamer," filed on Aug. 13, 2001.

TECHNICAL FIELD OF THE INVENTION

This invention relates in general to the field of subterranean exploration and, more particularly, to a pantograph underreamer.

BACKGROUND OF THE INVENTION

Underreamers are generally used to form an enlarged cavity in a well bore extending through a subterranean formation. The cavity may then be used to collect resources for transport to the surface, as a sump for the collection of well bore formation cuttings and the like, or for other suitable subterranean exploration and resource production operations. Additionally, the cavity may be used in well bore drilling operations to provide an enlarged target for constructing multiple intersecting well bores.

One example of an underreamer includes a plurality of cutting blades pivotally coupled to a lower end of a drill pipe. Centrifugal forces caused by rotation of the drill pipe extend the cutting blades outward and diametrically opposed to each other. As the cutting blades extend outward, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outward at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

Accordingly, a need has arisen for an improved underreamer that provides increased control of subterranean cavity formation. The present invention provides a pantograph underreamer that addresses shortcomings of prior underreamers.

According to one embodiment of the present invention, an underreamer for forming a cavity within a well bore includes a housing rotatably disposed within the well bore. The underreamer also includes a sleeve slidably positioned around the housing. The underreamer further includes at least one cutter set each having a first end pivotally coupled to the housing and a second end pivotally coupled to the sleeve. An axial force applied to the sleeve is operable to slide the sleeve relative to the housing and extend the cutter sets radially outward relative to the housing from a retracted position to form the cavity when the housing is rotated relative to the well bore.

According to another embodiment of the present invention, a method for forming a cavity within a well bore includes positioning an underreamer within the well bore. The underreamer includes a housing and a sleeve. The sleeve is slidably positioned around the housing. The underreamer further includes at least one cutter set where each cutter set includes a first end coupled to the housing and a second end coupled to the sleeve. The method further includes applying an axial force to the sleeve and extending the cutter sets radially outward from a retracted position relative to the housing and the sleeve in response to movement of the sleeve relative to the housing from the applied force. The method further includes rotating the underreamer within the well bore to form the cavity.

The invention provides several technical advantages. For example, according to one embodiment of the present invention, an axial force is applied to a sleeve of the underreamer to cause outwardly directed movement of cutter sets into a subterranean formation. The axial force applied to the sleeve may be varied to produce corresponding varying pressures on the formation by the cutter sets. Thus, the present invention may be used to accommodate a variety of formation densities and compositions. Additionally, decreased rotational speeds of the underreamer may be used to form the cavity, thereby substantially reducing or eliminating hazards associated with high speed rotating mechanisms.

Another technical advantage of the present invention includes substantially reducing or eliminating out-of-balance conditions resulting from rotation of the underreamer within a well bore. For example, according to one embodiment of the present invention, an end of each of the cutter sets is coupled to the sleeve, thereby resulting in substantially uniform extension and increased precision of each of the cutter sets relative to the underreamer housing. Thus, out-of-balance conditions caused by varying positions of cutting blades are substantially reduced or eliminated.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Figure 1:
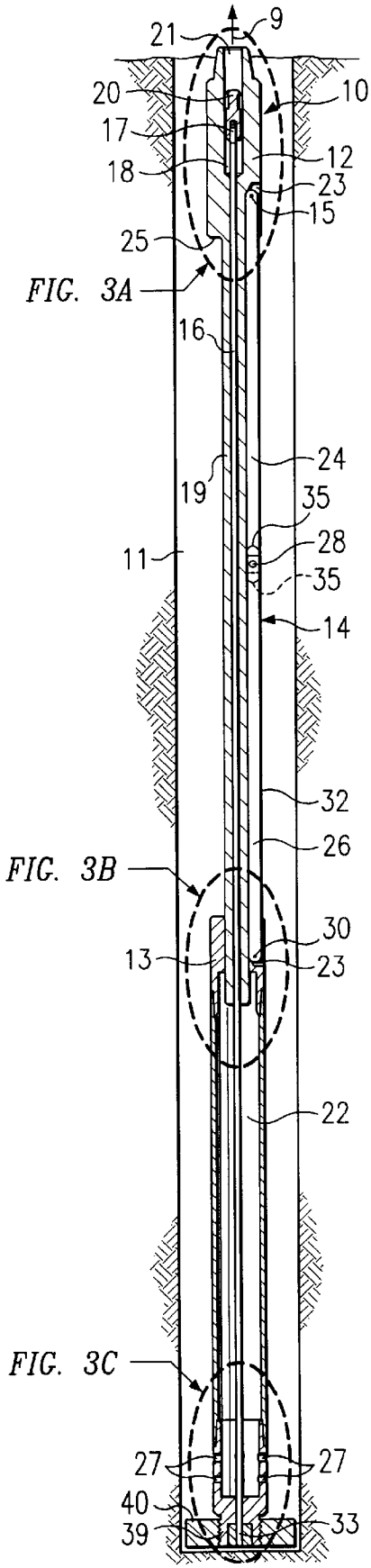
FIG. 1 is diagram illustrating a cross-section of a pantograph underreamer in accordance with an exemplary embodiment of the present invention.

FIG. 1 is a diagram illustrating a multi-blade underreamer 10 in accordance with an exemplary embodiment of the present invention. Underreamer 10 includes a housing 12 illustrated as being substantially vertically disposed within a well bore 11. However, it should be understood that underreamer 10 may also be used in non-vertical cavity forming operations. Underreamer 10 also includes at least one cutter set 14 pivotally coupled to housing 12. FIG. 1 illustrates one cutter set 14; however underreamer 10 may have more than one cutter set 14 disposed in a similar manner as cutter set 14 of FIG. 1, and having three or five cutter sets 14 may add stability to underreamer 10. In this embodiment, cutter set 14 is pivotally coupled to housing 12 via a pin 15; however, other suitable methods may be used to provide pivotal or rotational movement of cutter sets 14 relative to housing 12.

Underreamer 10 includes a sleeve 13 slidably positioned around housing 12. Sleeve 13 has an internal passage 22 which receives a neck portion 19 of housing 12. Neck portion 19 may have any suitable shape or configuration, such as one that is round or hexagonal. Sleeve 13 may also have drainage ports 27 to allow for drainage into well bore 11 of any fluid which may collect in internal passage 22. Underreamer 10 also includes an actuation rod 16 coupled to sleeve 13 at end 33 of actuation rod 16. Actuation rod 16 is slidably positioned within an internal passage 18 of housing 12. Actuation rod 16 includes a fishing neck 20 coupled to an end 17 of actuation rod 16. Housing 12 includes a recess 21 capable of receiving fishing neck 20 while underreamer 10 is in the retracted position. Fishing neck 20 is operable to engage a fishing tool (not expressly shown) lowered within well bore 11 to which an axial force is applied, which in turn slides actuation rod 16 and sleeve 13 relative to housing 12. The axial force is a force in a direction along the longitudinal axis of actuation rod 16. Such direction is illustrated in FIG. 1 by arrow 9. The fishing tool can be a 1½" jar down to shear tool; however, other suitable fishing tools may be used to receive an upward force and in turn slide actuation rod 16 and sleeve 13 relative to housing 12. Housing 12 also includes annular shoulder 25 to receive sleeve 13 and limit movement of sleeve 13 relative to housing 12.

Cutter set 14 contains a first cutter 24 and a second cutter 26. It should be understood that the cross-sections of first cutter 24 and second cutter 26 may have various shapes and configurations. For example, first cutter 24 and second cutter 26 may have a round, hexagonal or any other shape as a cross-section. Furthermore, such cross-sectional shape and configuration may differ at different locations on first cutter 24 and second cutter 26. First cutter 24 is pivotally coupled to second cutter 26. In this embodiment, first cutter 24 is pivotally coupled to a second cutter 26 via a pin 28; however, other suitable methods may be used to provide pivotal or rotational movement of cutter sets 14 relative to one another.

The locations on each first cutter 24 and second cutter 26 where cutters 24 and 26 are coupled may be at a point that is not at the ends of first cutter 24 and/or second cutter 26. Coupling first and second cutters 24 and 26 at a location other than their ends can shield and protect pins 28 during rotation of underreamer 10 since pins 28 would not be in contact with exposed surfaces of well bore 11 during rotation. Coupling first and second cutters 24 and 26 at such locations also allows for tips 35 of cutters 24 and 26 to absorb much of the wear and tear from contact with well bore 11. In particular embodiments, tips 35 may be replaced as they get worn down during rotation of underreamer 10 and may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation.

Second cutter 26 is pivotally coupled to sleeve 13. In this embodiment, second cutter 26 is pivotally coupled to sleeve 13 via a pin 30; however, other suitable methods may be used to provide pivotal or rotational movement of the second cutter 26.

In the illustrated embodiment, housing 12 and sleeve 13 also include outwardly facing recesses 23, which are each adapted to receive a cutter set 14. First cutter 24 and second cutter 26 each comprises an outwardly disposed cutting surface 32 and an end cutting surface 36 (illustrated in FIG. 2). Cutting surfaces 32 and 36 may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 32 and 36 configurations may be machined or formed on first cutter 24 or second cutter 26 to enhance the cutting characteristics of cutters 24 or 26.

Underreamer 10 also includes a stabilizer 40 for substantially maintaining a concentric position of housing 12 and sleeve 13 relative to well bore 11 during rotation of housing 12 for cavity formation. In the embodiment illustrated in FIG. 1, stabilizer 40 is threadably coupled to a lower end 39 of sleeve 13 and sized slightly smaller than a size of well bore 11 to accommodate downward travel of underreamer 10 within well bore 11 while minimizing lateral movement of housing 12 and sleeve 13 during cavity formation. However, it should be understood that other suitable methods and devices may also be used to stabilize the housing within well bore 11 to limit lateral movement of housing 12 and sleeve 13.

Figure 2:
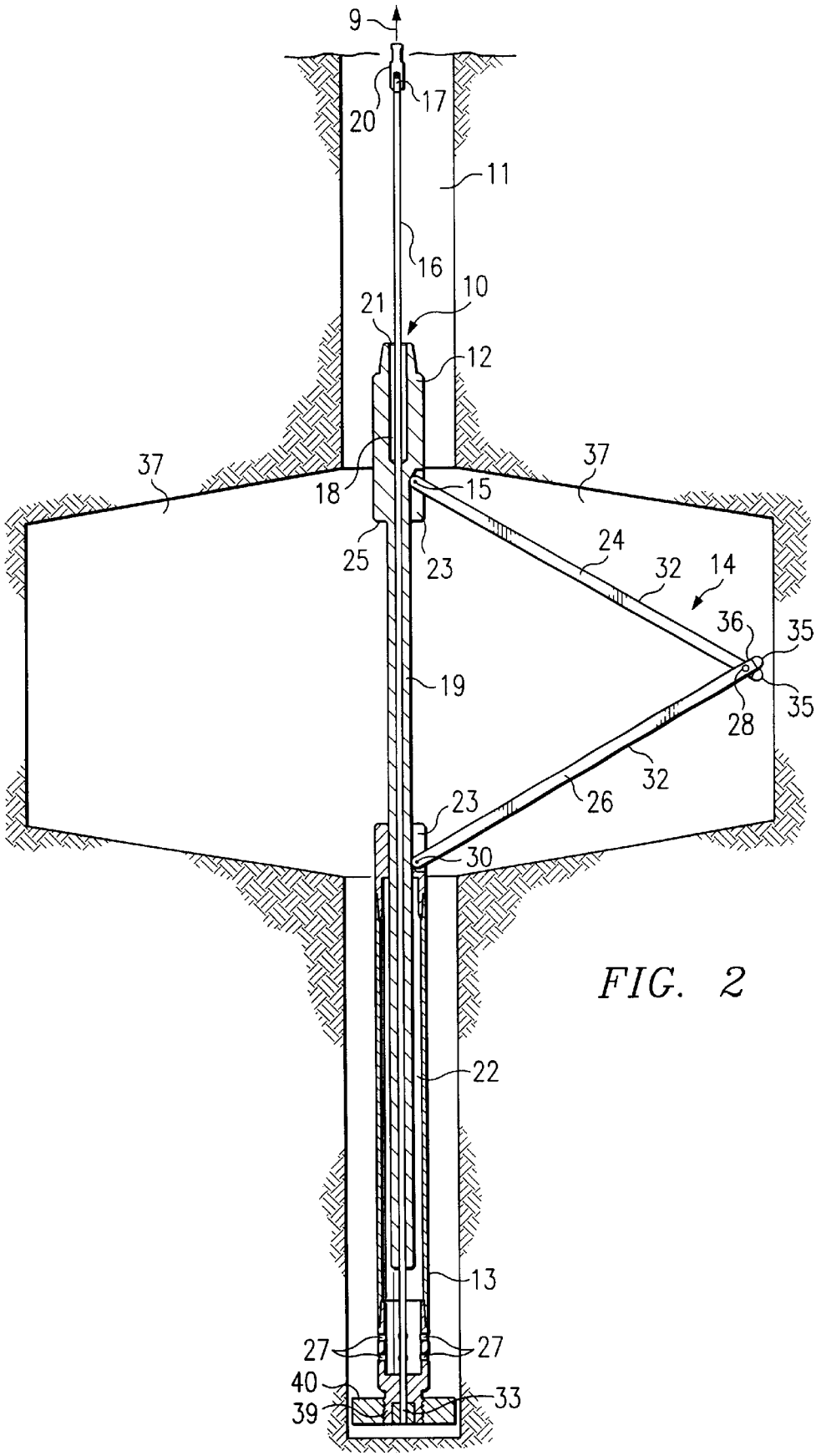
FIG. 2 is a diagram illustrating the pantograph underreamer illustrated in FIG. 1 in an extended position.

FIG. 2 is a diagram illustrating underreamer 10 illustrated in FIG. 1 having cutter set 14 disposed in an extended position relative to housing 12 and sleeve 13. In FIG. 2, actuation rod 16 and sleeve 13 are illustrated in an upwardly disposed position relative to housing 12.

In response to movement of actuation rod 16 and sleeve 13 relative to the housing 12, first cutter 24 rotates about pin 15 and second cutter 26 rotates about pin 30 extending cutter set 14 radially outward relative to housing 12. Housing 12 is rotated within well bore 11 as cutter set 14 extends radially outward relative to housing 12. Rotation of housing 12 may be achieved via a drill string attached to housing 12; however, other suitable methods of rotating housing 12 may be utilized. The drill string may also aid in stabilizing housing 12 in well bore 11. Through the rotation of housing 12 and extension of cutter set 14 via the movement of actuation rod 16 and sleeve 13 relative to housing 12, underreamer 10 forms an enlarged cavity 37 as cutting surfaces 32 and 36 come into contact with the surfaces of well bore 11. Actuation rod 16 may be moved both in the direction of arrow 9 and in the opposite direction via the fishing tool during rotation of housing 12 to further define cavity 37 being formed, and underreamer 10 may be moved in such directions to further define and shape cavity 37 within well bore 11. It should be understood that a subterranean cavity having a shape other than the shape of cavity 37 may be formed with underreamer 10.

Figure 3C:
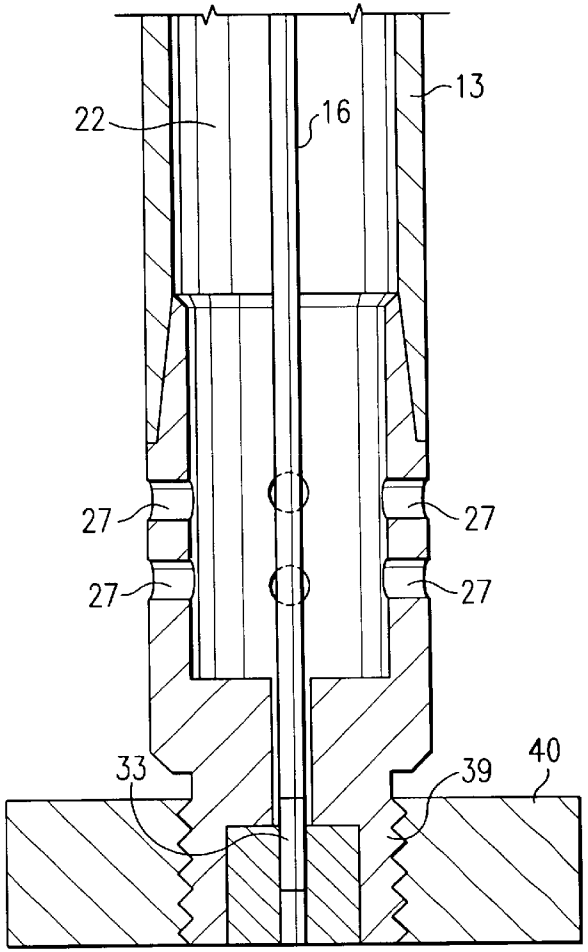
FIG. 3C is a diagram illustrating an enlarged view of section 3C of the pantograph underreamer illustrated in FIG. 1.
Figure 3B:
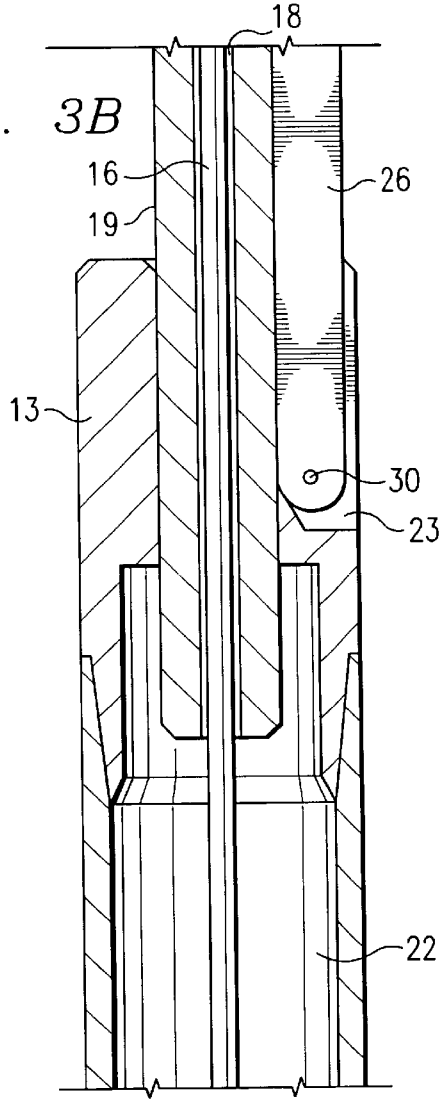
FIG. 3B is a diagram illustrating an enlarged view of the section 3B of the pantograph underreamer illustrated in FIG. 1.
Figure 3A:
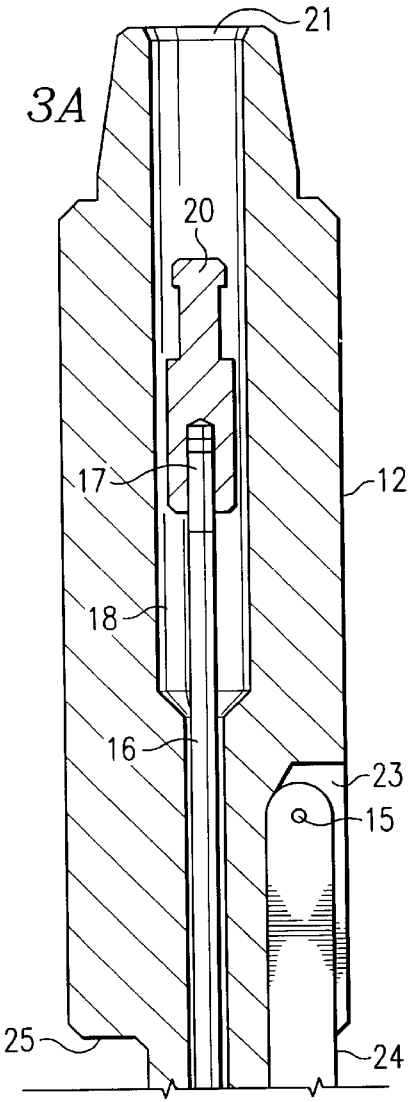
FIG. 3A is a diagram illustrating an enlarged view of the section referenced 3A of the pantograph underreamer illustrated in FIG. 1.

FIG. 3A shows an enlarged view of section 3A of FIG. 1. As illustrated, when underreamer 10 is in the retracted position, fishing neck 20, coupled to end 17 of actuation rod 16, is positioned within internal passage 18 of housing 12. First cutter 24 is disposed within outwardly facing recess 23 of housing 12. FIG. 3A also shows annular shoulder 25 of housing 12 which may limit movement of sleeve 13 relative to housing 12 when the axial force is applied. Such limitation will also limit the extension of cutter sets 14 as actuation rod 16 and sleeve 13 move relative to housing 12.

FIG. 3B shows an enlarged view of section 3B of FIG. 1. As illustrated, when underreamer 10 is in the retracted position, neck portion 19 of housing 12 is partially positioned within internal passage 22 of sleeve 13. Second cutter 26 is disposed within outwardly facing recess 23 of sleeve 13. Actuation rod 16 passes through internal passage 18 of neck portion 19 as well as internal passage 22 of sleeve 13.

FIG. 3C shows an enlarged view of section 3C of FIG. 1. Actuation rod 16 passes through internal passage 22 of sleeve 13 and is coupled with sleeve 13 at end 33 of actuation rod 16. As illustrated, drainage ports 27 allow for any fluid which may collect in internal passage 22 to drain out to well bore 11. Stabilizer 40 is coupled to lower end 39 of sleeve 13 and helps to minimize lateral movement of sleeve 13 and the housing within the well bore.

Figure 4:
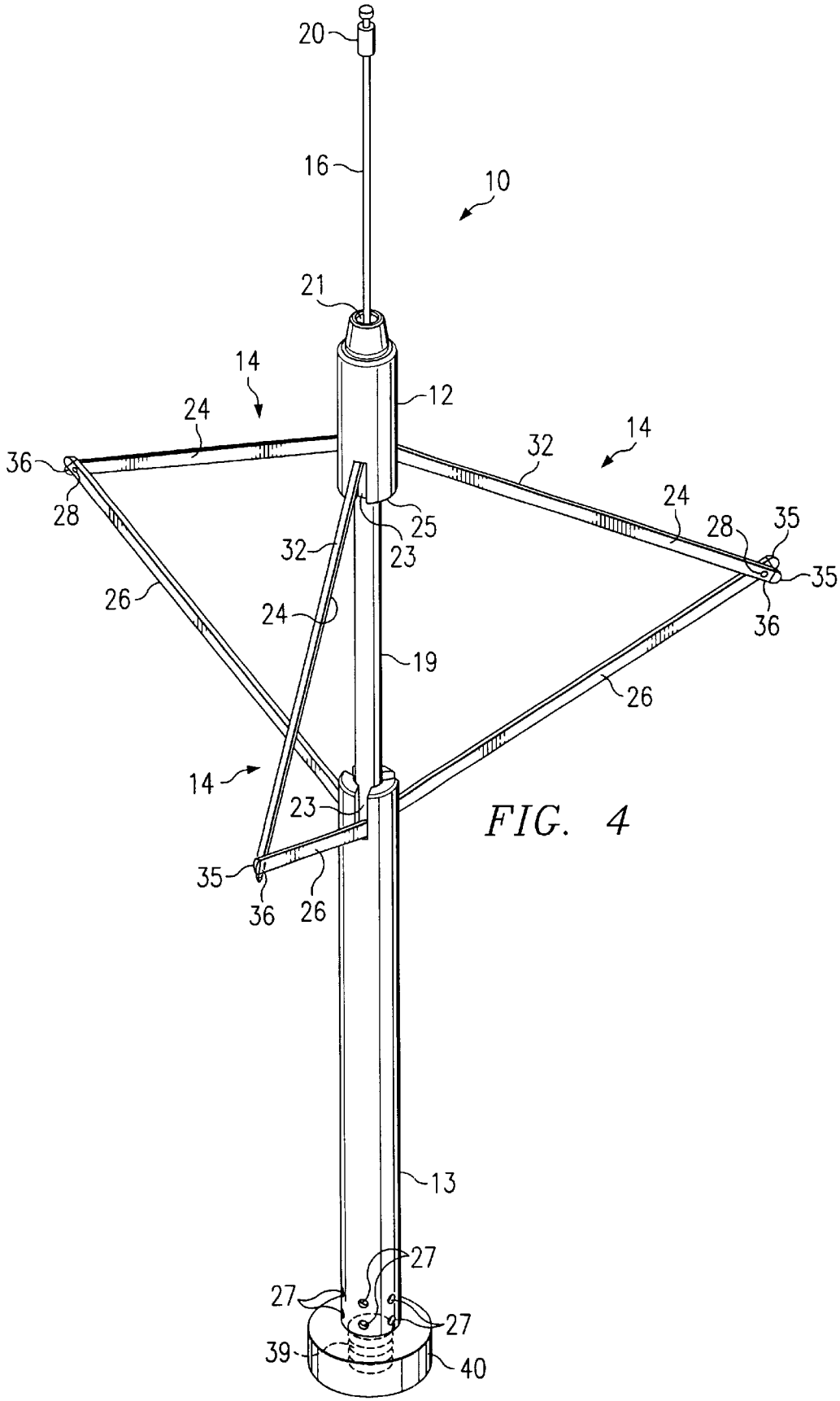
FIG. 4 is an isometric diagram illustrating a pantograph underreamer in accordance with another embodiment of the present invention.

FIG. 4 is a diagram illustrating a pantograph underreamer in accordance with another embodiment of the present invention. In FIG. 4, underreamer 10 has three cutter sets 14.

Although the present invention has been described in detail, various changes and modifications may be suggested to one skilled in the art. It is intended that the present invention encompass such changes and modifications as falling within the scope of the appended claims.

What is claimed is:

1. An underreamer for forming a cavity within a well bore, comprising:

a housing adapted to be rotatably disposed within the well bore;

a sleeve slidably positioned around the housing;

an actuation rod coupled to the sleeve, the actuation rod extending through an internal passage of the housing; and at least one cutter set, each cutter set having a first end pivotally coupled to the housing and a second end pivotally coupled to the sleeve, wherein an axial force applied to the actuation rod is operable to slide the sleeve relative to the housing and extend the cutter sets radially outward relative to the housing from a retracted position to form the cavity when the housing is rotated relative to the well bore.

2. The underreamer of claim 1, wherein the sleeve comprises a first end and a second end, the second end of each cutter set coupled to the first end of the sleeve, the actuation rod coupled to the second end of the sleeve.

3. The underreamer of claim 1, further comprising a fishing neck coupled to the actuation rod, the fishing neck adapted to engage a fishing tool disposed within the well bore, the fishing tool operable to apply the axial force to the actuation rod.

4. The underreamer of claim 3, wherein the housing comprises an inwardly facing recess adapted to receive the fishing neck when the cutter sets are in the retracted position.

5. The underreamer of claim 1, wherein the housing comprises a first end and a second end, the sleeve slidably disposed over the second end of the housing.

6. The underreamer of claim 1, wherein the housing comprises a neck portion, and wherein the sleeve comprises an internal passage configured to receive the neck portion.

7. The underreamer of claim 1, wherein the housing and the sleeve each comprise outwardly facing recesses each adapted to receive one of the cutter sets when the cutter sets are in the retracted position.

8. The underreamer of claim 1, wherein each cutter set comprises:

a first cutter having a first end and a second end, the first end of the first cutter coupled to the housing;

a second cutter having a first end and a second end, the first end of the second cutter coupled to the sleeve; and the second end of the first cutter being pivotally coupled to the second end of the second cutter.

9. The underreamer of claim 8, wherein the second ends of the first and second cutters extend radially outward relative to the housing when the axial force is applied to the actuation rod.

10. The underreamer of claim 8, wherein at least one of the first and second cutters comprises a replaceable tip at its second end, the replaceable tip extending past the point at which the first and second cutters are coupled.

11. The underreamer of claim 8, wherein the sleeve comprises a first end and a second end, the first end of the second cutter coupled to the second end of the sleeve, and wherein the housing comprises an annular shoulder operable to receive the first end of the sleeve to limit movement of the sleeve relative to the housing.

12. The underreamer of claim 1, further comprising a stabilizer coupled to the sleeve and operable to stabilize the sleeve within the well bore during formation of the cavity.

13. A method for forming a cavity within a well bore, comprising:

positioning an underreamer within the well bore, the underreamer having a housing and a sleeve, the sleeve slidably positioned around the housing, the underreamer further having at least one cutter set, each cutter set having a first end coupled to the housing and a second end coupled to the sleeve;

applying an axial force to an actuation rod coupled to the sleeve, wherein applying the axial force comprises sliding the actuation rod through an internal passage of the housing;

extending the cutter sets radially outward from a retracted position relative to the housing and the sleeve in response to movement of the sleeve relative to the housing from the applied force; and rotating the underreamer within the well bore to form the cavity.

14. The method of claim 13, wherein applying the axial force further comprises receiving a neck portion of the housing within an internal passage of the sleeve.

15. The method of claim 13, further comprising extending a fishing tool into the well bore to engage a fishing neck coupled to the actuation rod, and wherein applying the axial force comprises applying the axial force to the fishing neck via the fishing tool.

16. The method of claim 13, wherein extending the cutter sets comprises sliding the sleeve over a portion of the housing.

17. The method of claim 13, wherein each of the cutter sets comprises a first cutter and a second cutter pivotally coupled to the first cutter, each of the first and second cutters having a first end and a second end, the first end of the first cutter corresponding to the first end of the cutter set, the first end of the second cutter corresponding to the second end of the cutter set.

18. The method of claim 17, wherein sliding the sleeve comprises extending the second ends of the first and second cutters radially outward relative to the sleeve and the housing.

19. The method of claim 17, wherein at least one of the first and second cutters comprises a replaceable tip at its second end, the replaceable tip extending past a point at which the first and second cutters are coupled.

20. The method of claim 13, wherein extending the cutter sets radially outward comprises sliding the sleeve relative to the housing until an end of the sleeve engages a corresponding shoulder of the housing.

21. The method of claim 13, further comprising stabilizing the sleeve within the well bore during rotation of the underreamer.

22. An underreamer for forming a cavity within a well bore, comprising:

a housing;

a sleeve slidably positioned around the housing; and at least one first cutter, each first cutter having a first end and a second end, each first end pivotally coupled to the housing;

at least one second cutter, each second cutter pivotally coupled to a respective first cutter, each second cutter having a first end and a second end, the first end of each second cutter pivotally coupled to the sleeve, wherein movement of the sleeve relative to the housing extends the second ends of the first and second cutters radially outward relative to the housing from a retracted position; and an actuation rod coupled to the sleeve and extending through an internal passage of the housing, the actuation rod operable to receive an axial force to provide the movement of the sleeve relative to the housing.

23. The underreamer of claim 22, wherein at least one of the first and second cutters comprises a replaceable tip at its second end, the replaceable tip extending past a point at which the first and second cutters are coupled.

24. The underreamer of claim 22, wherein the underreamer comprises a central axis, and wherein the second ends of the first and second cutters are disposed substantially along the central axis.

25. The underreamer of claim 22, wherein the sleeve comprises a first end and a second end, the first end of each second cutter coupled to the first end of the sleeve, the actuation rod coupled to the second end of the sleeve.

26. The underreamer of claim 25, further comprising a fishing neck coupled to the actuation rod, the fishing neck adapted to engage a fishing tool disposed into the well bore, the fishing tool operable to apply the axial force to the actuation rod.

27. The underreamer of claim 22, wherein the housing comprises a first end and a second end, the sleeve slidably positioned around the second end of the housing.

28. The underreamer of claim 22, wherein the housing comprises a neck portion, and wherein the sleeve comprises an internal passage configured to receive the neck portion.

29. The underreamer of claim 22, wherein the second ends of the first and second cutters are operable to extend radially outward to a distance of between three to four feet relative to a central axis of the underreamer.

30. The underreamer of claim 22, wherein the sleeve comprises a first end and a second end, the first end of each second cutter coupled to the first end of the sleeve, and wherein the housing comprises an annular shoulder operable to receive the first end of the sleeve to limit movement of the sleeve relative to the housing.

31. The underreamer of claim 30, further comprising an actuation rod extending through an internal passage of the housing and coupled to the second end of the sleeve, the actuation rod operable to transfer an axial force to the sleeve to provide the movement of the sleeve relative to the housing.

32. The underreamer of claim 22, further comprising a stabilizer coupled to the sleeve and operable to stabilize the sleeve within the well bore during formation of the cavity.

* * * * *